United States Patent [19]

Marikar et al.

[11] Patent Number: 4,746,541

[45] Date of Patent: May 24, 1988

[54] ELECTRICALLY CONDUCTIVE THERMALLY STABILIZED ACRYLIC FIBROUS MATERIAL AND PROCESS FOR PREPARING SAME

[75] Inventors: Yusuf M. F. Marikar, Scotch Plains; Michael M. Besso, West Orange, both of N.J.

[73] Assignee: Hoechst Celanese Corporation, Somerville, N.J.

[21] Appl. No.: 809,654

[22] Filed: Dec. 16, 1985

[51] Int. Cl.[4] ..... B05D 5/12

[52] U.S. Cl. ..... 427/126.1; 8/624; 427/443.1

[58] Field of Search ..... 427/126.1, 443.1; 8/624

[56] References Cited

U.S. PATENT DOCUMENTS 4,336,028 6/1982 Tomibe et al. ..... 427/126.1

*Primary Examiner*—James J. Bell

*Attorney, Agent, or Firm*—Burns, Doane, Swecker & Mathis

[57] ABSTRACT

An electrically conductive fibrous material and a process for preparing the same from a thermally stabilized acrylic fibrous material are provided. The thermally stabilized acrylic fibrous material is first contacted with cuprous ions to produce a cuprous ion-impregnated fibrous material, and subsequently is subjected to a sulfiding agent capable of sulfiding cuprous ions, and preferably washed, to produce thermally stabilized acrylic fibrous material having covellite copper sulfide in association therewith. Also provided are electrically conductive composites and a process for preparing the same by incorporating the fibrous material prepared in accordance with the process within a substantially continuous polymeric matrix.

54 Claims, 3 Drawing Sheets

880X

880X

9200X 10,000X

ELECTRICALLY CONDUCTIVE THERMALLY STABILIZED ACRYLIC FIBROUS MATERIAL AND PROCESS FOR PREPARING SAME

BACKGROUND AND OBJECTS OF THE INVENTION

This invention relates to a process for preparing electrically conductive fibrous material from a thermally stabilized acrylic fibrous material, and to the fibrous material produced thereby. The invention further relates to an electrically conductive composite comprising electrically conductive thermally stabilized acrylic fibrous material surrounded with a continuous polymeric or resinous matrix and to a process for preparing the same. The invention is useful for EMI (electromagnetic interference) shielding, and electrostatic discharge as well as in forming electrically conductive resins and paints.

It is known in the art to treat polyacrylonitrile fibers with cupric sulfate, hydroxylamine, and thiosulfate to produce electrically conductive fibers having adsorbed thereto copper sulfide in the forms of digenite, chalcocite, and covellite, alone or in conjunction with sulfides of noble metals, in a total amount of up to 30 percent in terms of elemental copper based on the weight of the starting fiber. (See Tomibe et al, European Pat. No. 0 086 072 and U.S. Pat. No. 4,336,028.) However, these fibers possess various deficiencies: the polyacrylonitrile fibers are relatively heat unstable and tend to lose their integrity in various applications; for example, if the fibers are contacted with molten resinous material, the fibers disintegrate. Further, the copper sulfide content is only partially in the form of covellite, the most conductive of the forms of copper sulfide, thus rendering the fibers inadequately conductive for many applications. Additionally, high levels of copper sulfide incorporation (e.g., greater than about 30 weight percent) are not possible according to the processes of the prior art.

It is also known to produce copper sulfide-coated electrically conductive fibers from other synthetic or natural polymers. (See Tomibe et al, U.S. Pat. Nos. 4,364,739, 4,378,226, and 4,410,593.) However, each of these fibers possesses the same deficiencies as the above-described fibers.

It is also known to produce elemental copper-plated acrylate/styrene/acrylonitrile articles or articles of other polymers by depositing a copper compound and subsequently reducing with a borohydride. (See U.S. Pat. Nos. 4,234,628 and 4,246,320 to DuRose and Coll-Palagos et al, respectively.) However, many of the above-noted deficiencies are inherent in these articles.

Further, it is known in the art to produce composite articles by loading organic fibrous material and/or inorganic fillers into a resinous matrix. For example, U.S. Pat. No. 2,956,039 to Novak et al discloses metal-plated fibers (e.g., of wool, polyethylene terephthalate, or nylon) or metal particles in admixture with an epoxy resin to produce an electrically insulating composition. U.S. Pat. No. 3,658,750 to Tsukui et al discloses an electrically insulating composition comprising a thermosetting resin and 40 to 80 volume percent of a powdered filler which may be cuprous sulfide or cupric sulfide. U.S. Pat. No. 4,155,896 to Rennier et al discloses a composition comprising copper plated steel or glass fibers dispersed in an organic coating. U.S. Pat. No. 3,658,748 to Andersen et al discloses a composite comprising reinforcing fibers (e.g., of polyacrylonitrile) embedded in a thermosettable resin. However, each of these compositions possesses various deficiencies, including insufficient conductivity for certain applications and difficulty of processing the composite due to poor thermal stability of the filler material.

It is therefore an object of the present invention to provide a process for preparing improved electrically conductive fibrous materials, particularly highly conductive materials.

It is a still further object of the present invention to provide a process for preparing an improved electrically conductive fibrous material which is flexible and ductile.

It is a further object of the present invention to provide an improved electrically conductive fibrous material having covellite copper sulfide in association therewith, wherein the copper sulfide is substantially entirely in the form of covellite copper sulfide.

It is a still further object of the invention to provide a process for preparing a composite article which incorporates an improved electrically conductive fibrous material which is heat stable and which may be processed in a molten polymeric matrix without destruction of the fibrous material.

It is a still further object of the invention to provide an electrically conductive monolithic composite incorporating an improved electrically conductive fibrous material.

It is a still further object of the invention to provide an electrically conductive polymer composition incorporating an improved electrically conductive fibrous material.

It is a still further object of the invention to produce fibrous material which is suitable for use in electrostatic discharge and EMI shielding applications and other applications where electrically conductive composites are desired.

These and other objects, as well as the scope, nature, and utilization of the claimed invention will be apparent to those skilled in the art by the following detailed description and appended claims.

SUMMARY OF THE INVENTION

According to the present invention, an electrically conductive fibrous material is prepared from a thermally stabilized acrylic fibrous material by (a) supplying a source of cuprous ions to the thermally stabilized acrylic fibrous material to produce a cuprous ion-impregnated thermally stabilized acrylic fibrous material;

(b) contacting the resulting cuprous ion-impregnated thermally stabilized acrylic fibrous material with a sulfiding agent capable of sulfiding the cuprous ions to form covellite copper sulfide in association with the thermally stablized acrylic fibrous material; and, optionally, (c) washing the resulting thermally stabilized acrylic fibrous material containing associated covellite copper sulfide to remove residual reactants adhering to the same.

In a preferred embodiment, an electrically conductive fibrous material is prepared from a thermally stabilized acrylic fibrous material by (a) cuprous ion-impregnating the thermally stabilized acrylic fibrous material with an aqueous solution of between about 0.25 and about 10 weight percent of copper ions, added as cupric sulfate, and between about 0.5 and 10 weight percent of an hydroxylamine reducing agent while at a temperature of between about 80 and about 105° C. for between about 1 and about 2 hours;

(b) subjecting the resulting cuprous ion-impregnated fibrous material to a sulfiding treatment in a solution comprising a thiosulfate sulfiding agent in a concentration of approximately 5 to 15 percent by weight while at a temperature of between about 90 and about 105° C. for an additional period of time between about 1 and about 2 hours to produce an electrically conductive fibrous material having covellite copper sulfide in association therewith; and (c) washing the resulting thermally stabilized acrylic fibrous material to substantially remove residual reactants adhering to the same.

In another aspect of the invention, an electrically conductive fibrous material is provided which comprises thermally stabilized acrylic fibrous material in association with approximately 5 to 60 percent, and preferably 35 to 60 percent, by weight of covellite copper sulfide, based upon the total weight of the product.

In another aspect of the invention, an electrically conductive composite article is prepared by a process comprising the steps of:

(a) cuprous ion-impregnating a thermally stablized acrylic fibrous material with a solution of a cupric salt and a reducing agent capable of reducing cupric ions to cuprous ions;

(b) subjecting the resulting cuprous ion-impregnated thermally stabilized fibrous material to a sulfiding treatment in a solution comprising a sulfiding agent capable of sulfiding the cuprous ions to covellite copper sulfide in association with said fibrous material to produce electrically conductive thermally stabilized acrylic fibrous material;

(c) washing the resulting electrically conductive thermally stabilized acrylic fibrous material to substantially remove residual reactants adhering to same; and (d) incorporating the resulting electrically conductive fibrous material within a substantially continuous polymeric matrix to produce a monolithic electrically conductive composite article.

In still another aspect, a monolithic electrically conductive composite article is provided which comprises electrically conductive thermally stabilized acrylic fibrous material in association with approximately 5 to 60 percent by weight of covellite copper sulfide based upon the total weight of the conductive fiber product, incorporated within a substantially continuous polymeric matrix.

In yet another aspect, a polymer composition suitable for use in electrically conductive end uses is provided, comprising electrically conductive thermally stabilized acrylic fibrous material in association with approximately 5 to 60 weight percent of covellite copper sulfide and a polymeric carrier.

DESCRIPTION OF THE PREFERRED EMBODIMENT

Figure 1:
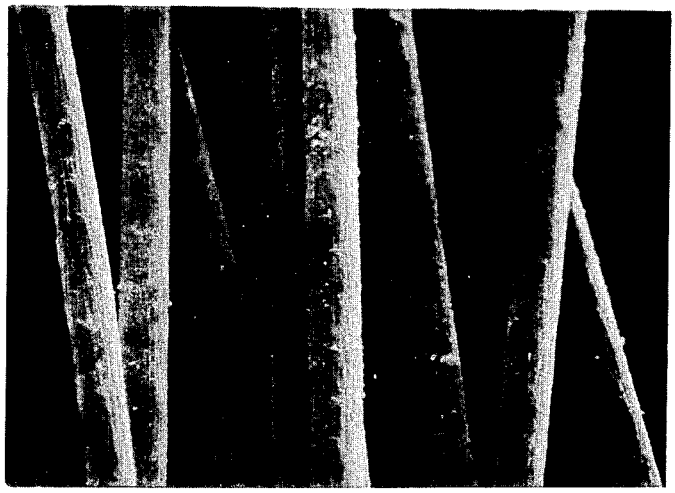
FIG. 1 is a magnified (880×) photograph of the electrically conductive thermally stabilized acrylic fibrous material produced in accordance with the procedure of Example I.

The fibrous material which is rendered electrically conductive in accordance with the present invention is a thermally stabilized acrylic fibrous material which can be produced by methods previously known in the art.

The acrylic fibrous material prior to thermal stabilization may be formed by conventional solution spinning techniques (i.e., may be dry spun or wet spun), or high pressure melt spinning, and commonly is drawn to increase its orientation. As is known in the art, dry spinning commonly is conducted by dissolving the polymer in an appropriate solvent, such as N,N-dimethylformamide or N,N-dimethylacetamide, and passing the solution through an opening of predetermined shape into an evaporative atmosphere (e.g., nitrogen) in which much of the solvent is evaporated. Wet spinning commonly is conducted by passing a solution of the polymer through an opening of predetermined shape into an aqueous coagulation bath. High pressure melt spinning is conducted by applying high steam pressure to the polymer, which has been heated to near the melting point, thus forcing an extrudate through an opening of predetermined shape.

The acrylic polymer prior to thermal stabilization is formed primarily of recurring acrylonitrile units. For instance, the acrylic polymer may be an acrylonitrile homopolymer or acrylonitrile copolymer containing at least 85 mole percent acrylonitrile units (e.g. at least 95 mole percent acrylonitrile units) and up to about 15 mole percent of one or more monovinyl units copolymerized therewith (e.g., up to at least 5 mole percent of one or more monovinyl units). Representative monovinyl units may be derived from styrene, methyl acrylate, methyl methacrylate, vinyl acetate, vinyl chloride, vinylidene chloride, vinyl pyridine, and the like. A preferred acrylic polymer prior to stabilization is an acrylonitrile copolymer containing approximately 98 mole percent acrylonitrile units copolymerized with approximately 2 mole percent of recurring methyl acrylate units.

The acrylic fibrous material prior to thermal stabilization may optionally be drawn in accordance with conventional techniques in order to improve its orientation. For instance, the starting material may be drawn by stretching while in contact with a hot shoe at a temperature of about 140° to 160° C. Additional representative drawing techniques are disclosed in U.S. Pat. Nos. 2,455,173; 2,948,581; and 3,122,412, which are herein incorporated by reference. It is recommended that the acrylic fibrous materials prior to thermal stabilization be drawn to a single filament tenacity of at least about 2.5 grams per denier. If desired, however, the starting material may be more highly oriented, e.g., drawn up to a single filament tenacity of about 7.5 to 8 grams per denier, or more.

The acrylic fibrous material prior to thermal stabilization may be provided in a variety of physical configurations. For instance, the acrylic fibrous material prior to thermal stabilization may be in the form of a staple yarn, continuous filament yarn, multifilamentary tow, tape, strand, cable, fibrils, fibrids, paper, woven fabric, nonwoven fabric, etc. Continuous filament yarns may be provided with a twist of about 0.1 to 5 tpi, and preferably about 0.3 to 1.0 tpi, in order to improve handing characteristics. Alternatively, one may select bundles of acrylic fibrous material which possess substantially no twist.

The thermal stabilization reaction commonly is conducted by heating the acrylic fibrous material in an oxygen-containing atmosphere at a temperature within the range of approximately 200° to 350° C. to render the same non-burning when subjected to an ordinary match flame. Such thermal stabilization reaction may be conducted in accordance with techniques known in the art. For instance, the multiple stage thermal stabilization process of U.S. Pat. No. 3,539,295, which is herein incorporated by reference, may be employed. The oxygen-containing atmosphere preferably contains about 1 to 40 percent by weight of molecular oxygen, and in a particularly preferred embodiment is air. The fibrous material preferably is maintained under longitudinal tension at a substantially constant length during the thermal stabilization reaction. Residence times for the thermal stabilization reaction at a temperature within the range of approximately 200° to 350° C. are commonly about 1 to 5 hours, or more, and are influenced by the denier of the fibrous materials as will be apparent to those skilled in the art. Batch or continuous processing techniques may be employed.

At the conclusion of the thermal stabilization reaction the fibrous material is black in appearance and commonly contains a bound oxygen content of at least 6 percent by weight (e.g., 7 to 12 percent by weight) as determined by the Unterzaucher analysis. While not wishing to be bound by theory, it is believed that the thermal stabilization reaction involves (1) an oxidative cross-linking reaction of adjoining molecules as well as (2) a cyclization reaction of pendant nitrile groups to a condensed dihydropyridine structure.

Alternatively, the thermal stabilization reaction may be assisted by the use of various processing techniques which tend to shorten the time required to accomplish the desired thermal stabilization. For example, thermal stabilization techniques employing high energy sources such as lasers can be used. Representative processes which can be used to form the thermally stabilized acrylic fibrous material on an accelerated basis are disclosed in U.S. Pat. Nos. 3,416,874; 3,592,595; 3,647,770; 3,650,668; 3,656,882; 3,656,883; 3,708,326; 3,729,549; 3,767,773; 3,813,219; 3,814,577; 3,820,951; 3,850,876; 3,917,776; 3,923,950; 3,961,888; 4,002,426; 4,004,053; 4,295,844; 4,364,916; 4,370,141; etc. The disclosures of these patents are herein incorporated by reference.

It has been found that better adhesion of the copper sulfide as formed is obtained when the thermally stabilized acrylic fibrous material is washed with a solvent to remove impurities, preferably at an elevated temperature, e.g. from about 30° C. to the boiling point of the solvent. The solvent for such washing can be an aliphatic alcohol having from 1 to about 3 carbon atoms, a halocarbon having from 1 to about 3 carbon atoms, or a halogenated hydrocarbon having from 1 to about 3 carbon atoms. In a preferred embodiment, the fibrous material is washed in methanol under reflux conditions.

The thermally stabilized fibrous material which is to be made electrically conductive in accordance with the present invention is cuprous ion-impregnated by contact with a source of cuprous ions in a solution. Cuprous ions have been found capable of dispersing into the fibrous material more readily and more completely than cupric ions or elemental copper. Firstly, elemental copper cannot be incorporated into the fibrous material except by physical entrapment or plating. By analytical methods (X-Ray Absorption Near Edge Spectra) capable of distinguishing between cupric and cuprous ions it has been determined that the copper species in the treated fibers is substantially cuprous. While not wishing to be bound by theory, it appears that the cuprous ions are preferentially complexed by the pre-oxidized acrylic material, since hydroxylamine is a moderate reducing agent and reduces only about 1 percent of the cupric ions in solution at any given time, but the final proportion of the cuprous ions in the fibrous material is much higher than would be predicted by their concentration in the treatment solution.

The solvent for the cuprous ion solution may be water, or nonaqueous media such as acetonitrile, propylene carbonate or butyrolactone. In a presently preferred embodiment, an aqueous solution is employed.

Inasmuch as most commercially available cuprous compounds (e.g., cuprous chloride, cuprous oxide, cuprous cyanide, cuprous iodide and the like) are insoluble in water, the cuprous ions are preferably supplied by in situ reduction of cupric ions. In a preferred embodiment, cupric ions are supplied in a reducing agent-containing aqueous solution in the form of a water-soluble cupric salt such as cupric sulfate, cupric chloride, cupric nitrate, cupric acetate, cupric formate, cupric bromide, cupric perchlorate, complex salts of copper and the like, and mixtures thereof, such that reduction of cupric ions to cuprous ions occurs in solution. In a most preferred embodiment, the source of cupric ions is cupric sulfate in an aqueous solution.

The cupric salt is supplied in a solution at a concentration sufficient to produce a cupric ion concentration of approximately 0.1 to 15 percent by weight, based on total weight of the solution. In a preferred embodiment, the cupric salt is supplied at a concentration sufficient to produce a cupric ion concentration of approximately 0.25 to 10 percent by weight based on total weight of the solution. In a most preferred embodiment for good conductivity and physical properties, the solution comprises cupric ions in a concentration of approximately 2 percent by weight. The conductivity of the fibrous material treated generally varies with the concentration of the cupric ion in solution and available for reduction, but at the higher concentrations of cupric ion, the advantage of higher conductivity may be offset by mechanical deterioration of the fibers due to over impregnation.

A reducing agent is supplied with the cupric ion source to reduce cupric ions to cuprous ions in solution, preferably in an equivalent concentration. Preferably, the reducing agent is hydroxylamine, or an hydroxylamine addition salt, e.g., hydroxylamine sulfate, hydroxylamine hydrochloride, hydroxylamine nitrate, hydroxylamine acetate, hydroxylamine formate, hydroxylamine bromide, and the like, and mixtures thereof, with the most preferred reducing agent presently being hydroxylamine sulfate. However, other salts such as sodium hypophosphite, sodium bisulfite, sodium dithionite, sodium formaldehyde sulfoxylate and zinc formaldehyde sulfoxylate can also be used. The latter two salts are available commercially from Virginia Chemicals Co. under the trademarks Discolite and Parolite, respectively. Copper metal can also be used as the reducing agent, in forms such as powder, turnings, wire or other finely divided materials.

The soluble reducing agent (i.e., other than copper metal) is supplied in an amount which is soluble in the cupric ion-containing solution and which is sufficient to at least partially reduce the cupric ions present to the cuprous oxidation state. The concentration for the reducing agent in the solution will generally range from approximately 0.1 to 20 percent by weight of active ingredient (e.g., hydroxylamine) based on the total solution weight. In a preferred embodiment, the reducing agent is present in the solution as between about 0.5 and about 10 percent by weight of the solution based on the total solution weight. In a most preferred embodiment, the reducing agent comprises about 5 percent by weight of the solution. When copper metal is used as the reducing agent, it need only be present in a quantity at least sufficient to substantially completely reduce the cupric ions present to the cuprous oxidation state, and is preferably present in a slight excess.

The pH of the solution may be controlled at approximately 1 to 5 by the addition of sulfuric acid, hydrochloric acid, nitric acid, acetic acid or other acids, and sodium hydroxide, potassium hydroxide or other bases to the solution. Control of the pH can be achieved by buffering agents such as potassium hydrogen phthalate, citrate, tartrate, and the like.

The temperature of the resulting cuprous ion-containing solution is preferably elevated (e.g., above about 60° C.). In a preferred embodiment, the temperature of the aqueous solution during the cuprous ion-impregnating step is between about 80° and about 105° C. at atmospheric pressure. In a most preferred embodiment, the temperature of the aqueous solution is about 100° C. Higher temperatures, e.g., in the range of from about 100° to about 150° C., can be used in high pressure equipment such as pressure dyeing equipment, and in steam-heated ovens. Long filaments, tow or roving can also be treated continuously in a steam oven. Elevated temperatures are expected to shorten the duration of treatment.

Contact time between the thermally stabilized acrylic fibrous material and the cuprous ion-containing solution in the cuprous ion-impregnating step may be between about 5 minutes and about 10 hours in duration. In a preferred embodiment, the contact time is between about 15 minutes and about 2 hours in duration. During such contact, the thermally stabilized acrylic fibrous material is preferably maintained at a constant length. The required contact between the thermally stabilized acrylic fibrous material and the cuprous ion-containing solution can be accomplished by a variety of techniques including immersion, spraying, drip feeding, padding, etc. In small quantities, loose hanks of filaments or tow can be immersed in the solution, while in larger quantities, it is convenient to wind the filaments loosely on a bobbin which can be immersed and gently rotated in a tank of the solution. In a preferred embodiment for production, a continuous length of the fibrous material can be passed in the direction of its length through a bath containing the cuprous ion-containing solution which is continuously or intermittently replenished, or passed through a zone where the solution is applied by spraying, padding or drip feeding.

Following a cuprous ion impregnating step of appropriate duration, the thermally stablized acrylic fibrous material comprises cuprous ions dispersed substantially uniformly throughout the fibrous material. This fact is evidenced by elemental mapping using the characteristic X-ray emission in an electron microscope. However, the uniform penetration and distribution of cuprous ions throughout the fibrous material is not essential, as the desired conductivity may in some cases be achieved by cuprous ion impregnation which is limited to surface areas. If a relatively low concentration of the cuprous ions in the fibrous material is desired, e.g., for production of low conductivity fibers, the material may optionally be washed prior to contact with the sulfiding agent.

Following the cuprous ion-impregnating step, the cuprous ion-impregnated thermally stabilized acrylic fibrous material is contacted with a sulfiding agent which is capable of sulfiding cuprous ions to form electrically conductive copper sulfide in association with the thermally stabilized acrylic fibrous material. Suitable sulfiding agents include sodium thiosulfate, potassium thiosulfate, lithium thiosulfate, rubidium thiosulfate, cesium thiosulfate, sodium sulfide, sulfur dioxide, sodium hydrogen sulfite, sodium pyrosulfite, sulfurous acid, dithionous acid, sodium dithionite, thiourea dioxide, hydrogen sulfide, sodium formaldehyde sulfoxylate, and zinc formaldehyde sulfoxylate and the like, or mixtures thereof. Some of these agents, such as, e.g., sodium hydrogen sulfite, sodium dithionite, sodium formaldehyde sulfoxylate, and zinc formaldehyde sulfoxylate can serve as combination reducing and sulfiding agents. The preferred sulfiding agents are the alkali metal thiosulfates. The most preferred sulfiding agent at present is sodium thiosulfate.

The sulfiding agent is preferably contacted with the cuprous ion-impregnated thermally stabilized acrylic fibrous material by addition of the sulfiding agent directly to the cuprous ion-containing solution. The contact occurs for an additional time period of between about 15 minutes and about 10 hours. In a preferred embodiment, the additional contact time is between about 1 and about 2 hours in duration. During such contact, the thermally stabilized acrylic fibrous material is preferably maintained at a constant length. Again, the required contact between the cuprous ion-impregnated fibrous material and the sulfiding agent-containing solution may be accomplished by a variety of techniques including immersion, spraying, drip feeding, padding, etc. In a preferred embodiment, a continuous length of the fibrous material is again passed in the direction of its length through a bath containing the sulfiding agent-containing solution which is continuously or intermittently replenished. In an embodiment, a solution of a copper thiosulfate complex chilled to a temperature where it is homogeneous (e.g. 0°–5° C.) is applied to the fibrous material, then precipitates copper sulfide when the material is warmed to at least about room temperature.

The sulfiding agent comprises between about 0.1 and about 30 percent by weight of the solution which is contacted with the cuprous ion-impregnated fibrous material, based on total solution weight. Preferably, the solution comprises between about 5 and about 15 percent by weight of the sulfiding agent. Most preferably, the solution comprises about 10 percent by weight of the sulfiding agent, based on total solution weight.

Preferably, the aqueous solution comprising the sulfiding agent is again maintained at an elevated temperature, e.g., between about 90° and about 105° C. at atmospheric pressure. Most preferably, the aqueous solution is maintained at about 100° C. Higher temperatures, preferably at superatmospheric pressure, can be used to accelerate the treatment. At present, the highest conductivities are obtained in an embodiment in which the cuprous solution is cooled, e.g., to a temperature of about 80° C., a sulfiding agent such as a thiosulfate is added, and the temperature of the solution is then raised, e.g., to the range of about 100°–103° C.

Following the sulfiding treatment, the resulting fibrous material is preferably washed to remove residual reactants adhering thereto, and dried. Washing may be achieved by rubbing or agitating in a tank or under running water, spraying with a jet of water, and the like. Drying may be accomplished by hot air, superheated steam or vacuum drying.

Following the sulfiding treatment, substantially all of the copper ions are sulfided. In a preferred embodiment, at least about 80 percent, and preferably between about 90 and about 98 percent of the sulfided copper (i.e., copper sulfide) is in the covellite form, with the remainder generally being in the form of digenite, having the empirical formula $Cu_9S_5$. In a most preferred embodiment, the copper sulfide is substantially entirely (e.g., at least 97 percent) in the covellite form. Preferably, the resulting copper sulfide consists essentially of covellite copper sulfide.

By the term "covellite" is meant copper sulfide of a stoichiometric formula CuS, with a crystallographic structure identical to that of the copper sulfide mineral covellite of the same stoichiometry. The crystal structure is described by R. W. G. Wyckoff in CRYSTAL STRUCTURES, 2d Ed., Vol. I, R. E. Krieger Publ. Co. (1982), at page 145, which is herein incorporated by reference. Contrary to expectation, the copper is not in the cupric (divalent) state and all the copper and sulfur atoms are not equivalent. The structure is hexagonal with an elongated six molecule cell; $a_o=3.796$ Å and $c=16.36$ Å. Of the six sulfur atoms per unit cell, four are associated to two $S_2$ groups (S-S: 2.05 Å); two of the six copper atoms have triangular coordination (CuS: 2.19 Å) and the other four have tetrahedral coordination (Cu-S: 2.31 Å). All the copper is reduced to $Cu^+$ and CuS is diamagnetic. The monosulfide is a metallic conductor at room temperature and is superconducting below 1.62° K.

It is highly desirable that the copper sulfide is in the covellite form, as covellite is the most highly electrically conductive known form of copper sulfide. The chemical structure of the copper sulfide is verified by X-ray diffraction techniques.

Figure 4:
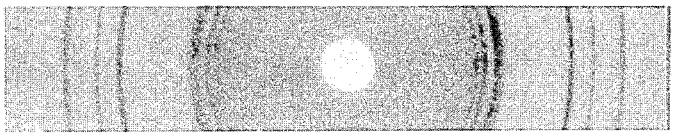
FIG. 4 is an X-ray diffraction pattern of the electrically conductive thermally stabilized acrylic fibrous material produced in accordance with the procedure of Example I, showing the covellite copper sulfide phase in a Debye-Scherrer pattern.

FIG. 4, an X-ray diffraction pattern of the electrically conductive thermally stabilized acrylic fibrous material produced in accordance with the procedure of Example I, shows the covellite copper phase in a Debye-Scherrer pattern. The pattern was identified as that of covellite by a computer search of JCPDS files, correlating with JCPDS card 6-464. (The JCPDS card for digenite is card 23-962.) The proportion of covellite produced can be affected by the duration of the sulfiding treatment; for example, after the fiber has soaked in cuprous ion solution for 1 hour, mixtures of covellite and digenite can be observed after sulfiding for one-half or 1 hour, but only covellite is observed after 2 hours of sulfiding. At this point, every line in the x-ray diffraction pattern can be attributed to the covellite phase, with no lines characteristic of the digenite phase being discernible. The digenite phase, if present at all, is believed to constitute less than about 3 percent of the crystalline phases. While not wishing to be bound by theory, observations of trials thus far are consistent with a mechanism wherein both covellite and digenite phases are formed initially, with generation of the digenite continuing, but then disproportionating to form a covellite phase.

Figure 2:
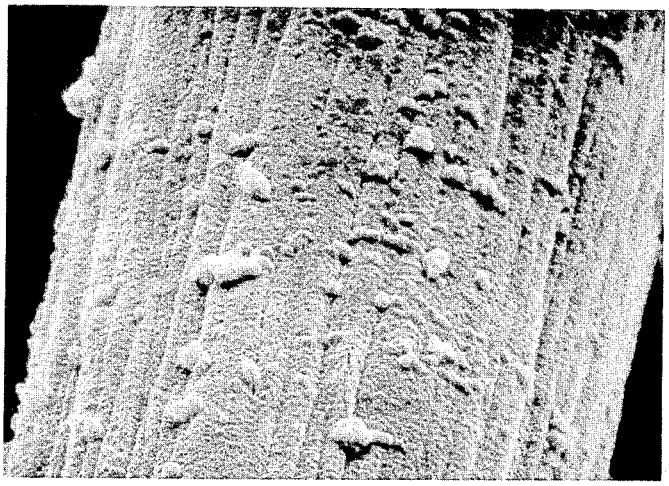
FIG. 2 is a magnified (9200×) photograph of the surface of the electrically conductive thermally stabilized acrylic fibrous material produced in accordance with the procedure of Example I.
Figure 3:
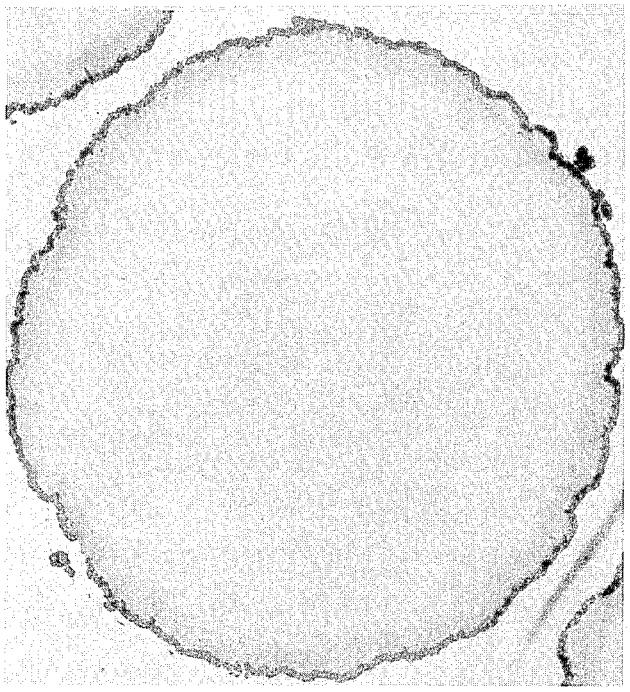
FIG. 3 is a magnified (10,000×) photograph showing a cross-section of the fibrous material depicted in FIGS. 1 and 2.

With respect to the physical configuration of the copper sulfide relative to the fibrous material, during the sulfiding step, most of the copper sulfide appears to precipitate out of the fibrous material and to form in association with the fibrous material, a solid layer of copper sulfide having a thickness of approximately 0.05 to 2 microns (preferably 0.1 to 0.2 micron) at the surface of the fibrous material (See FIG. 2). Studies of the cuprous ion-impregnated fibers by elemental mapping of the copper and sulfur using wavelength dispersive analysis and back-scattered electron imaging revealed that the copper ions are distributed throughout the fiber rather than being restricted to the surface. However, examination of the fibers after completion of the sulfidation step showed a sulfide layer of less than 0.4 micron thickness on the fiber surface, with some residual copper and sulfur in the fiber matrix. While not wishing to be bound by theory, it is believed that the consolidation of most of the CuS as formed at the fiber surface is responsible for the high conductivity observed in the fibers. Also, it is believed that the precipitation of CuS by migration of the copper ions from within the polymer material rather than by mere "coating" from the solution phase accounts for the good adhesion of this inorganic phase which has been observed. By the phrase "in association with the fibrous material" it is meant that the copper sulfide is substantially entirely directly in contact with the fibrous material, i.e., either on the surface of the fibrous material or dispersed within the fibrous material or a combination thereof. In a preferred embodiment, the covellite copper sulfide forms a substantially continuous coating on the outside of the fiber, and penetrates the fiber surface to at least about 1 micron depth, as indicated by electron microscope studies. The coating covers all the recesses and protrusions on the substrate fiber surface, and is typically about 0.05–1 micron thick, although no contiguous coating is observable in fibers of very low conductivity. The application of coatings of excessive thickness would probably lead to exfoliation, which could have the undesirable effect of reducing the flexibility of the fibers. The coating appears to be continuous (FIG. 1, 2) and the resulting fibrous material is ductile and heat stable up to approximately 300° C.

The conductive fibrous material preferably comprises between about 5 and 60 percent by weight of the covellite copper sulfide after the sulfiding step, based on total weight of fibrous material and copper sulfide, i.e., the total weight of the product. In preferred embodiments, covellite copper sulfide constitutes between about 5 and about 15 percent or between about 25 and about 35, or between about 35 and 60 percent of the total weight of the product.

Various techniques can be used to control the amount of copper sulfide deposited in the fibrous material, and the proportion of the desired highly conductive covellite phase, including the concentrations of the cuprous ion and sulfiding solutions, temperatures and the times of contact with the solutions. For example, the highest concentrations of copper sulfide of the covellite phase are obtained when cuprous ions are present in solution as the material is contacted with the sulfiding solution, while the concentration can be reduced by washing the material before contact with the sulfiding solution.

Figure 5:
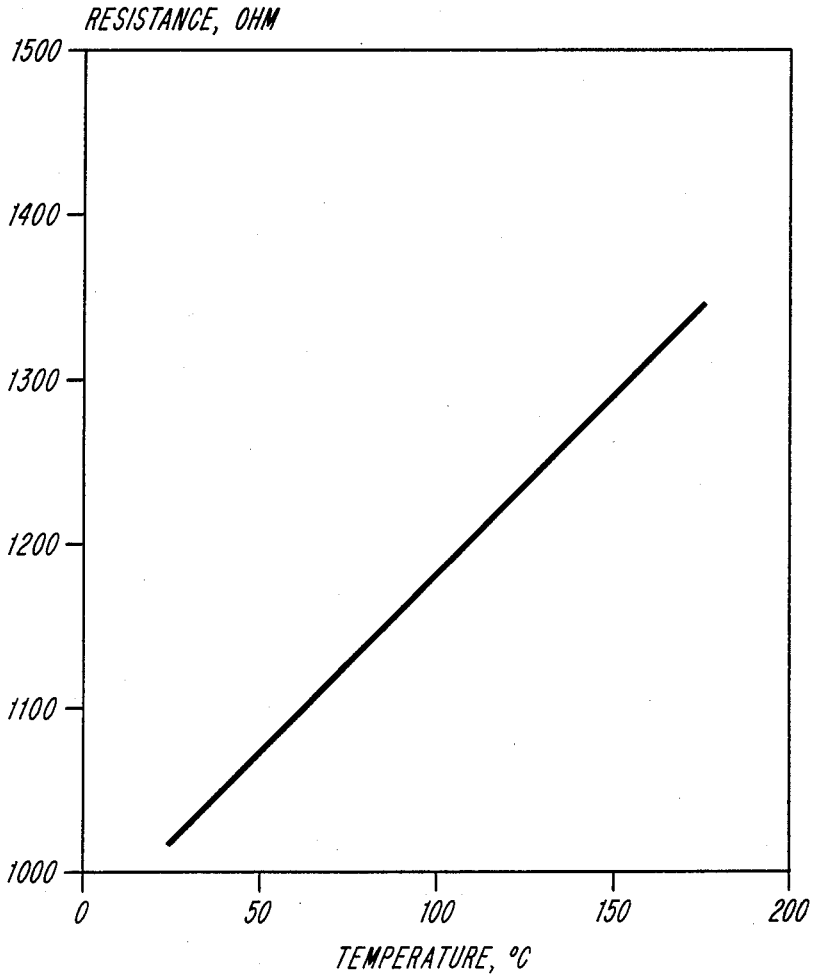
FIG. 5 is a graph of the resistance variation with temperature of the electrically conductive thermally stabilized acrylic fibrous material produced in accordance with the procedure of Example I.

The resulting fibrous material exhibits electrical conductivity of the metallic type, i.e., the resistance increases gradually and linearly with increasing temperature as with metals, rather than decreasing rapidly as with semi-conductors; see FIG. 5. At 25° C., the electrical conductivity commonly is between about 0.001 and about 1000 $ohm^{-1}cm^{-1}$ in the direction of the fiber length, and preferably between about 100 and about 1000 $ohm^{-1}cm^{-1}$. In a most preferred embodiment, the fibrous material exhibits an electrical conductivity of between about 500 and about 1000 $ohm^{-1}cm^{-1}$ in the direction of its fiber length at 25° C. The electrical conductivity conveniently was determined by measuring the resistance of the multifilament tow by using an ohmmeter, as well as by mounting individual fibers, attaching conducting adhesive contacts to them and measuring their resistance by both 2-point and 4-point methods.

The electrically conductive thermally stabilized fibrous material is preferably washed after the sulfiding step to remove excess reactants, which could otherwise affect the stability of the thermally stabilized acrylic fibrous material or the polymer used to form a matrix surrounding the fibers. Following washing and drying, the electrically conductive thermally stabilized fibrous material can be used while in a variety of physical configurations. For example, filaments or fibers prepared in accordance with the present invention can be used alone or mingled with non-electrically conductive synthetic or natural fibers to form sheetlike articles having at least one layer comprising a multiplicity of conductive fibers, e.g., electrically conductive fabrics or papers suitable for electrical heating tapes, electrostatic dissipation or shielding from electromagnetic radiation. Alternatively, yarns prepared according to the present invention may be used in preparing antistatic carpeting and the like.

Much like the individual fibers of the fibrous material, the woven or non-woven fabrics or papers incorporating the conductive fibrous material, optionally in combination with non-conductive synthetic or natural fibers, can have conductivity values in the range of from about 0.001 to about 1000 $ohm^{-1}cm^{-1}$, preferably in the range of from about 0.01 to about 500 $ohm^{-1}cm^{-1}$. Alternatively, the conductive properties of sheet materials can be expressed as sheet resistivity, with the materials generally having sheet resistivity values in the range of from about 0.1 to about 1000 ohms/square. The sheet resistivity of a material is the ratio of the potential gradient parallel to the current along the material to the current per unit width of the surface, and is numerically equal to the resistance between two electrodes forming opposite sides of a square, the size of which is immaterial. Sheet resistivity can be measured by methods comparable to those described for the measurement of surface resistivity of insulating materials in ASTM D-257-78 (as reapproved 1983). For example, conductive papers with sheet resistivity in the range of from about 300 to about 1000 ohms/square are useful in impedence matching layers for absorption of electromagnetic radiation, and high conductivity papers with sheet resistivity in the range of from about 0.1 to about 10 ohms/square are useful in electrical shielding and grounding aplications.

In another preferred embodiment, the electrically conductive fibrous material may be incorporated into a substantially continuous thermosetting or thermoplastic polymeric or resinous matrix to produce compositions which are useful for various purposes, e.g., forming into a monolithic electrically conductive composite article. The polymeric matrix can be flexible, rigid, elastomeric or pliable when cured or solidified. The composite article fabrication technique can be selected from any of those procedures previously employed in the advanced engineering composites art. For instance, tows, layers, ribbons, plies, fabrics, papers, etc. of the electrically conductive thermally stabilized acrylic fibrous material while in the desired physical configuration may be impregnated with an uncured thermosetting resin, stacked on top of each other, and cured under pressure at an elevated temperature to form a composite article wherein the cured thermoset resin serves as a solid continuous matrix phase. Alternatively, the electrically conductive thermally stablized acrylic fibrous material may be provided in the matrix material as relatively short length fibers (e.g., approximately 1/16 to 1 inch in length) in a relatively random configuration. In a preferred embodiment, the fibrous material is provided in relatively short lengths of between approximately ⅛ and ½ inches. Since the electrically conductive thermally stabilized acrylic fibrous material can withstand the elevated temperatures up to approximately 300° C. involved in mixing or molding processes without deleterious results, molten thermoplastic matrix-forming resins can be likewise employed. The various polymeric matrices into which the thermally stablized acrylic fibrous materials are incorporated can also include wetting agents, fire retardants, curing agents, reinforcing agents such as glass fibers or fillers such as silica. The acrylic fibrous materials can be coated with sizing to control their volume on chopping, as is commonly done in chopping carbon fibers.

In another preferred embodiment, the electrically conductive thermally stabilized acrylic fibrous material can be incorporated into polymeric compositions useful as molding compositions, liquid mixtures which can be cast and cured into composite articles or liquid mixtures, melts or solutions suitable for use as electrically conductive coatings. The coatings or other polymeric compositions can be cured by any suitable means, including chemical curing or crosslinking agents, thermal cures, ultraviolet light or other electromagnetic radiation, either ionizing or nonionizing.

Conductive polymeric compositions have previously been prepared by incorporating conductive particulate materials such as electroconductive carbon black or metals into a polymeric substrate, but the conductivity is limited by the volume of the particles which can be blended into the polymer without degrading its physical properties excessively. It has been found that fibrous materials, having a higher aspect ratio, can be blended into polymers in high weight proportions without causing such degradation, and furthermore are more effective in providing a conducting network due to their longitudinal dimensions. Thus, the effectiveness of fibrous materials such as carbon fibers can be measured by the volume percent incorporated into a polymeric substrate, although the cost of the materials will normally be based upon weight percent. Carbon fibers can be used to produce conductive polymeric compositions, but are expensive, so that they are used only when such fibers are also needed to provide reinforcement for the material.

The thermally stabilized acrylic fibrous material with copper sulfide associated therewith prepared in accordance with the present invention offers the advantage of fibers which can be made at least as conductive as carbon fibers at less cost, and used to produce a variety of conductive composite materials. Surprisingly, the fibers of the present invention are found to be resistant to physical breakdown when subjected to high temperature mixing processes, and thus can be used in compounding thermoplastic molding compositions without sacrificing conductivity.

Examples of suitable thermosetting polymeric materials, often referred to as engineering resins, into which the electrically conductive thermally stabilized acrylic fibrous material may be incorporated include epoxy resins such as epoxy esters, melamine resins, phenolic resins, polyimide resins, etc. Preferred thermosetting resinous materials include various epoxy and phenolic resins.

Examples of suitable thermoplastic polymeric materials, also referred to as engineering resins, into which the electrically conductive thermally stabilized acrylic fibrous material may be incorporated include polyolefins such as polyethylene and polypropylene, vinyl polymers such as polystyrene, polyacrylics and polyvinyl chloride; acrylonitrile butadiene styrene (ABS) copolymers, polycarbonates, polyamides such as various nylons; polyesters, polyphenylene oxide, polyphenylene sulfide, polysulfones, polyether sulfones, polyetherether ketones, polyetherimides, polysilicones, polyurethanes, polyarylates and polyacetals. Preferred thermoplastic polymeric materials include ABS resins, polycarbonates, nylon-6 and nylon-66, polyethylene terephthalate and polybutylene terephthalate.

The admixture of the electrically conductive thermally stabilized acrylic fibrous materials with such polymeric carriers results in polymer compositions suitable for employment in electrically conductive end uses. Such polymer compositions utilizing thermoplastic or thermosetting polymers as the carrier are capable of being molded into electrically conductive molded articles or composites. Thermoplastic molding compositions containing the conductive fibers of the invention can be mixed and pelletized in the conventional manner for use in extrusion molding apparatus and the like.

In addition to admixtures with polymeric carriers, the electrically conductive thermally stabilized acrylic fibrous materials of the present invention can be admixed with liquid monomers, oligomers or prepolymers, or solutions of polymers, which can be cured to solid form by any suitable means. For example, liquid monomers or prepolymers can be cured by the addition of chemical curing agents, catalysts or oxidants, electromagnetic radiation (including visible or ultraviolet light, X-rays, electron beams, gamma rays and the like), or by thermal means. For example, a monomer such as styrene or a substituted styrene can be cured by the addition of a chemical crosslinking agent such as divinylbenzene, and prepolymers such as phenol-formaldehyde resins can be cured by heating. Various monomers, prepolymers and polymers such as polyacrylamides can be crosslinked by exposure to gamma rays or electron beams.

In an embodiment, the polymeric carrier of the polymer composition exhibits adhesive characteristics (being selected from suitable polymers such as epoxy polymers, silicone polymers, neoprenes, acrylates, cyanoacrylates, polyurethanes, and the like), making the composition suitable for use as an electrically conductive adhesive composition. In an alternative embodiment, the polymeric carrier is a material such as a silicone polymer or epoxy polymer which retains a pliable or semi-fluid state so that it can be used as an electrically conductive putty, caulking compound, sealant or the like. In another em bodiment, the polymeric carrier is capable of forming a continuous coating and the resulting composition is suitable for use in the formation of a continuous electrically conductive coating on a substrate. For example, the carrier can be a melt of a thermoplastic polymer, a liquid monomer or prepolymer which can be cured in situ to form a solid coating, or a solution of a thermosetting or thermoplastic polymer which forms a solid coating as the solvent evaporates. The conductive fibers of the present invention can be suspended in coating compositions which are conventional paints, comprising a pigment and the polymer carrier in a solvent or thinner, or an emulsion paint, in which the polymer carrier is present in either a latex formed by emulsion polymerization or as an emulsion of the polymer itself. Such emulsion paints contain the polymer carrier in a dispersion of water, while the conventional or solvent paints dissolve the polymer in a suitable organic solvent. Such electrically conductive paints, as with the other electrically conductive coating compositions of the invention, can be dried or cured by any suitable means to form a continuous, solid electrically conductive coating.

In a preferred embodiment, the polymeric material prior to solidification is supplied as a liquid, i.e., at temperatures above its melting point, to facilitate ready mixing of the fibrous material therewith.

In addition to these synthetic polymers, the conductive fibers can be incorporated into suitable natural polymers such as natural rubber, which is thermoplastic but can be vulcanized or cured to solid form in various consistencies by the use of conventional curing agents. Synthetic rubbers such as neoprenes can also be used.

After solidification, a monolithic electrically conductive composite article results. The article may be flexible, pliable, elastomeric or relatively rigid depending on the polymeric matrix which is used. By "monolithic" is meant an article exhibiting substantially complete uniformity and which is solid and substantially void-free. In addition to conventional molded or cast articles, the composite article can be extruded or otherwise formed into a sheet having a thickness of approximately 1 mil to 1 inch, or even thicker, if desired. The composite article can contain a fabric, paper or felt which includes the conductive fibers, the fabric, paper or felt being incorporated within a solid continuous polymeric matrix as by, e.g., impregnation of a fabric with a liquid polymer or monomer which is subsequently cured. In an embodiment, the liquid polymer utilized can itself contain additional finely divided electrically conductive thermally stabilized acrylic fibrous material.

The composite article commonly comprises between about 0.5 and about 35 percent by volume of the fibrous material, based on the volume of the composite. In a preferred embodiment, the composite comprises between about 1 and about 10 percent by volume of the fibrous material. In another preferred embodiment, the composite article comprises between about 0.5 and about 2.5 percent by volume of the fibrous material. In a high conductivity embodiment, the composite article comprises from about 10 to about 30 percent by volume of the fibrous material. The polymer compositions used for the production of such composite articles can comprise corresponding proportions of the fibrous material.

The electrical conductivity of the composite article is of course, influenced by the conductivity of the fibrous material, the level of loading of the fibrous material and the degree of alignment of the electrically conducting fibers present therein. Generally, the fibers are distributed evenly and aligned in an omnidirectional manner to provide homogeneous electrical properties, but can be aligned in predominantly one direction, as, e.g. by extrusion of the composite, to provide a higher conductivity in that direction than in others. Generally, the electrical conductivity of such articles is between about $10^{-6}$ $ohm^{-1}cm^{-1}$ and about 10 $ohm^{-1}cm^{-1}$ at 25° C. when measured in at least one direction. Compositions having conductivities and resistivities in various ranges can be employed for different applications of the present invention. For example, compositions employed for antistatic purposes can have a conductivity in the range of from about $10^{-6}$ to about $10^{-3}$ $ohm^{-1}cm^{-1}$, preferably 0.0001 to about 0.001 $ohm^{-1}cm^{-1}$. Compositions intended for EMI shielding preferably have a conductivity in the range of from about 0.1 to about 10 $ohm^{-1}cm^{-}$.

While these DC resistivity and conductivity values are useful in the preparation of conductive compositions and composites for various purposes, those skilled in the art will recognize that the AC impedance of the composition and/or structures of which it is a part will need to be considered when the incident radiation is at high frequencies such as radio or microwave frequencies. Compositions prepared according to the present invention are highly effective in producing the appropriate conductivity or resistivity on the surface of objects to allow electromagnetic radiation at radio or microwave frequencies to be absorbed rather than reflected. In contrast, compositions prepared with metal particles are generally too conductive to produce the appropriate surface conductivity. Sheetlike composites prepared according to the present invention can have sheet resistivities in the range of from about 100 to about 1000 ohms/square. To achieve the desired results, the composition as applied to the object's surface should at least approximately match the sheet resistivity of free space, 377 ohms per square. Compositions which will produce composite articles or surfaces having sheet resistivities in the range of from about 300 to about 500, preferably about 400 ohms/square, are preferred for such applications.

The monolithic electrically conductive composite articles produced in accordance with the present invention are suitable for use in various applications requiring electrically conductive materials, especially those requiring highly conductive materials, including EMI shielding and radar absorption material; flexible microelectronics; electrostatic dissipation material; electrically conductive coatings or paints; pliable sealant material; and electrically conductive adhesives.

The following examples are given as specific illustrations of the invention. It should be understood, however, that the invention is not limited to the specific details set forth in the examples.

EXAMPLE I

Thermally stabilized acrylic fibrous material, available commercially as Celiox® fibers from CCF, Inc. and having a denier per filament of approximately 1 was selected as the material to be treated in accordance with the present invention. Such fibrous material was provided as a tow which had been previously formed by heating in an air atmosphere a continuous filament acrylic tow consisting of about 12,000 filaments and comprising approximately 98 mole percent of recurring acrylonitrile units and approximately 2 mole percent of recurring methyl acrylate units. The tow initially had been formed by wet spinning and had been hot drawn to increase its tenacity prior to the thermal stabilization treatment. Following the thermal stabilization reaction, the fibrous material was non-burning when subjected to an ordinary match flame and possessed a bound oxygen content in excess of 7 percent by weight as determined by the Unterzaucher analysis.

A 1.2 meter length of 12,000 filament tow of this thermally stabilized polyacrylonitrile-methyl acrylate copolymer was placed in a round-bottomed flask and refluxed for 30 minutes in 150 ml methanol. The tow was then dried and weighed. The 1.9 grams of tow was coiled and placed at the bottom of a 600 ml beaker. An aqueous solution of 30 g. $CuSO_4.5H_2O$ and 15 g. $(NH_2OH)_2.H_2SO_4$ in 300 ml water, having a pH of 3.3 and containing 2.2 weight percent copper and 1.75 weight percent hydroxylamine, was poured into the beaker. The beaker was then covered and placed in a heating mantle, where it was heated to a temperature of 100° C. in about 15 minutes. The temperature was maintained between about 100 and 105° C. for 2 hours. The solution was then allowed to cool.

A solution of 40 g. $Na_2S_2O_3.5H_2O$ in 100 ml water was then added to the beaker, producing a concentraton of 3.1 weight percent thiosulfate ion, and the contents were heated from about 40° C. to 100° C. in 15 minutes. The temperature was maintained between about 100° and 104° C. for 2 hours. The tow was removed from the beaker and washed repeatedly in cold water, then in hot water, and finally in methanol. The tow was then dried in a vacuum oven at 65° C. The weight of the tow increased to 2.65 g., representing a gain of 39 percent in weight.

It was found that the resulting covellite copper sulfide-associated fibrous material contained approximately 28 percent by weight copper sulfide which was primarily in the form of covellite, and that the covellite formed a coating of approximately 0.1 micron thickness on the surface of the fibrous material (about 10 microns in diameter), with the remainder of the covellite being fairly uniformly dispersed within the fibrous material. The fibrous material produced in Example I was flexible, ductile, and heat stable, and had the following electrical properties at 25° C. as determined by resistance measurements made by both 2-terminal and 4-terminal methods with baked Electrodag conducting paste (Acheson) contacts:

Individual filament resistivity. . .1340 ohm-cm
Conductivity . . .950 $ohm^{-1}cm^{-1}$ The adhesion of the copper sulfide to the thermally stabilized acrylic fibrous material and the flexibility of the conductive fibers were demonstrated by the lack of cracking and chipping along the periphery of a 0.1 inch diameter loop of a filament observed in an electron microscope. There was no observable peeling or chipping when a filament was fractured. The fracture cross-section did not reveal a clear boundary between the polymer and the copper sulfide, thus interpenetration is believed to be responsible for the remarkable adhesion observed.

The covellite copper sulfide fibers thus produced have been found to have a fairly stable resistivity over time, although with fibers of relatively high resistivity, the values may be affected by variations in ambient humidity.

FIG. 5 shows a plot of the variation of resistance of an individual filament of the covellite copper sulfide-impregnated material with temperature, obtained by monitoring the resistance of a fiber approximately 10 mm long, using an AC current of 0.3 microamperes. A linear resistance LR-400 AC resistance bridge was used for monitoring resistance at various temperatures during heating up and cooling down of the fiber. Resistance increases linearly with temperature, demonstrating that the conductivity is metallic in nature and the material is stable up to at least about 170° C.

The average resistivity of the fiber was calculated by multiplying the observed resistance per cm by the fiber cross-sectional area, and the fiber cross-sectional area was calculated from the denier and density of the sample.

The resistances measured for 3–5 mm segments along the length of individual filaments of the initial samples varied up to one order of magnitude. Since the tow was not scoured or washed prior to impregnation, it was thought that the presence of grease, dirt or other foreign material on the fiber surfaces could cause non-uniform impregnation or adhesion of the copper sulfide. Refluxing the thermally stabilized acrylic fibrous material in methanol revealed extraction of sufficient soluble material to turn the liquid pale yellow. It was found that addition of a methanol reflux step for the fibrous material prior to cuprous ion impregnation improved the weight gain of copper sulfide to a level of about 40 percent (from about 39 percent), presumably due to extraction of products of pyrolysis occurring during the thermal stabilization process. An increased uniformity of impregnation with copper sulfide was indicated by less variability of resistance along the filament length, the differences among segments of these fibers being at worst a factor of two.

To further demonstrate the heat stability of the resistance of conducting fibers prepared in accordance with the invention, a 50 mm length of a multifilament tow containing approximately 6000 filaments of thermally stabilized acrylic fibrous material associated with approximately 39 weight percent of covellite copper sulfide was prepared, and the resistance measured as 5.5 ohms using the procedures described above. The length of tow was vacuum dried in a glass ampoule, after which nitrogen was admitted to the ampoule and the ampoule containing the tow was heated to a temperature of 300° C. The ampoule was maintained at a temperature of 300° C. for 30 minutes, then cooled. After re-equilibrating the length of tow in ambient air, the resistance was measured as 5.2 ohms. Within the limits of experimental error, this indicates that conducting filaments prepared in accordance with the invention can retain stable resistance values even when heated for brief periods to temperatures as high as 300° C.

EXAMPLE II

The process of Example I was substantially followed except that, after washing and drying, the covellite-associated fibrous material was chopped into short (i.e., about ¼ inch) lengths and loaded into a diglycidyl ether of bisphenol A epoxy resin containing approximately 40 parts of a trifunctional primary amine curing agent (Jeffamine T403 curing agent) per 100 parts resin (available commercially as EPIREZ 508 ®, epoxy resin from Celanese Corporation having a viscosity of 4500 cps at 77° F.) by blending the fibers and resin thoroughly but gently in a mixer. The mixture was degassed initially in a vacuum oven at 30 inches mercury and room temperature for 20–30 minutes to remove bulk air. The chopped fibrous material made up various proportions of the molten-resin composition, as shown in Table 1. The molten resin composition was formed in a Telflon ® polytetrafluoroethylene mold (2" diameter, 1-15/16" long) filling the mold in 24% increments, and degassing for about 1 hour between increments. Total degassing time was about 4½ hours to 2½ hours at room temperature, followed by about 2 hours at 40°–45° C. After the mold was filled the top was secured and it was transferred to the revolving shaft of a Watt-C-Ranger oven, where it was revolved for about 2 hours at 65° C., then an additional 1½ hours at 90° C. to produce a void-free monolithic article containing unoriented fibrous material and having the conductivity measurements shown in Table 1. For electrical conductivity measurement, a cylindrical section of the composite was chosen. The faces of the cylinder were polished to a mirror finish. A thin film of gold-palladium alloy was sputtered onto both faces and copper foil was attached to the faces using conductive colloidal silver paste. The resistance of the known length of the cylinder was measured using an ohmmeter and the conductivity was calculated from the value of the resistance and the diameter of the composite cylinder.

TABLE 1

Conductivity of Resin-Fiber Composites

| Vol. % Fiber | Wt. % Fiber | Composite Conductivity ($ohm^{-1}cm^{-1}$) |
|---|---|---|
| 1 | 1.34 | 0.01 |
| 2 | 2.67 | 0.02 |
| 5 | 6.6 | 0.70 |
| 10 | 13.5 | 0.79 |
| 15 | 19.2 | 0.87 |

The results in Table 1 indicate that between 2 and 5 volume percent of the fiber, a point is reached at which conductivity of the composite increases by more than an order of magnitude. Such epoxy-based composites containing about 5–10 volume percent of the fibrous material of the invention have much higher conductivity than commercially available materials containing 10–25 volume percent of conductive fillers. These data indicate that filler volumes in the 2–5 percent range should be sufficient to provide 35 dB shielding in EMI applications. The conductivity values of the composites containing 10 and 15 volume percent fibers compared very favorably with composites containing 30–40 weight percent carbon fiber or aluminum flakes to achieve similar levels of conductivity

EXAMPLE III

Thermally stabilized acrylic fibrous material as described in Example I was treated to produce fibers of relatively low conductivities. Fibers having varied conductivities were prepared by controlling the concentration of the copper ion and reducing agent in the initial soaking solution, plus the concentration of sulfiding agent and the duration of both treatments. The treatments and results obtained from various samples are presented in Table 2. The weight gains due to copper sulfide impregnation were calculated after reequilibration of the fiber samples in ambient humid air, so that they would correspond to the dry weight gain, discounting differences in moisture regained. The weight percentage of copper in the resulting fibers was determined by chemical analysis. The copper sulfide crystalline phase was identified as covellite by x-ray diffraction in all samples except Sample 1, in which the signal was too weak for positive identification.

All the sample fibers having resistivity of over 0.1 ohm-cm were produced by soaking the copper solution into the polymer and subsequently sulfiding the fibers in solutions not containing copper ions. Transmission electron microscopy of ultrathin cross sections of the fibers revealed that under these conditions the copper sulfide is deposited as particles of 10 nanometers and smaller inside the fiber matrix; a continuous coating on the outside of the fiber as seen with high conductivity specimens was not observed. Beyond about 1 μm from the fiber periphery into the core, the copper sulfide particles are not easily resolved, and if present, are probably only a few nanometers in their largest dimension. Since much of the conducting material impregnated in the interior of the fiber may not contribute to DC conductivity, it is foreseeable that these fibers may display an interesting frequency dependence of conductivity.

The resistance of the fibers was measured after baking on graphite-vinyl, Electrodag 423 SS contacts to a 2–10 cm long tow sample. Pressed metal electrode contacts were used in the case of Samples 3 and 4, accounting in part for the ranges of values indicated in Table 2; also, specific processing conditions for these two samples could give rise to variable conductivity from one region to another. The average resistivity values listed in Table 2 were calculated from the tow resistance per unit length, knowing the number of filaments and assuming a diameter of 10 μm for the fibers. However, it should be noted that conductivity is not likely to be uniform along the fiber cross-section, since the periphery of the fibers is probably more conductive than the core.

The resistivity values listed in Table 2 indicate that fibers of thermally stabilized acrylic polymer can be impregnated with copper sulfide to produce fibers with conductivities equivalent to those of carbon fibers pyrolyzed at temperatures in the range of 800°–1300° C. The resistivity of the conducting fibers was found to be stable over long periods of time, although measured values in the lower conductivity range are influenced by ambient humidity. The humidity effects appear to be reversible. Unlike low conductivity carbon fibers, no appreciable long term change in resistance with time is observable in these samples.

Copper sulfide impregnation of thermally stabilized acrylic fibers, either isolated or contained in fabrics or other structures, can be used to produce materials of relatively low conductivity which have potential applications in the absorption of radiation at microwave and radio frequencies. Measurements of conductivity in the microwave frequency range of three samples of low conductivity indicated broad resistance minima in the 6 GHz to 12 GHz region of the frequency spectrum.

TABLE 2

| | Preparation of Low Conductivity Fibers | | | | | | | | |
|---|---|---|---|---|---|---|---|---|---|
| Sample | Metal M Conc., | Soak R wt. % | Step Time Hr | Conversion Agent Conc., % | Step Time Hr | Weight Gain, % | Copper Wt. % | Resistance ohm/cm** | Resistivity ohm-cm |
| 1 | 0.5 | 0.5 | 0.5 | 0.5 | 0.5 | 7 | 2.2 | 2K | 19 |
| 2 | 1.0 | 0.5 | * | 1.0 | 2.0 | 9 | NA | 5.2 | 0.05 |
| 3 | 1.0 | 1.0 | 1.0 | 1.0 | 1.0 | 12 | NA | 0.5–5 M | 5–50K |
| 4 | 10.0 | 5.0 | 0.25 | 10.0 | 0.5 | 20 | NA | 10–100K | 0.1–1K |
| 5 | 10.0 | 5.0 | 1.0 | 10.0 | 2.0 | 26 | 9.2 | 10 | 0.1 |
| 6 | 10.0 | 5.0 | * | 10.0 | 2.0 | 28 | NA | 1.7 | 0.016 |

* = One step process
NA = not available
M = copper sulfate, $CuSO_4.5H_2O$, weight percent in solution
R = Reducing Agent, hydroxylamine, weight percent in solution
Agent = Sulfiding Agent, sodium thiosulfate, weight percent in solution
**M = $10^6$, K = $10^3$
All samples were thermally stabilized polyacrylonitrile copolymer as in Example I, with resistance of 12K tow tested. Copper sulfide species detected by x-ray diffraction was covellite in all samples except Sample 1, where the signal was weak, and Sample 2 (results not available).

EXAMPLE IV

A scaled-up process was developed to produce ¼ pound samples of thermally stabilized acrylic fibrous material associated with covellite copper sulfide, as described in Example I. The 12,000 filament tow was loosely wound on a perforated polytetrafluoroethylene bobbin and rotated at 2 rpm in 13 liters of treatment solution. Reagent grade $CuSO_4.5H_2O$ and $(NH_2OH)_2.H_2SO_4$ were dissolved in tap water to make up a treatment bath having a copper ion concentration of 2.2 weight percent, and a hydroxylamine concentration of 1.75 weight percent. Reagent grade $Na_2S_2O_3.5H_2O$ was then added to produce a thiosulfate concentration of 3.1 weight percent. The bath was contained in a 19 liter glass vessel and directly heated by quartz immersion heaters. The bath was agitated by circulation at 700 ml/min. using a peristaltic pump. The tow was treated for one hour in a cuprous ion solution, then two hours in the solution with added thiosulfate. The thus treated tow was washed in tap water and dried in a circulating air oven. It was rewound on another bobbin; tangling was not found to be a serious problem. The weight gain due to copper sulfide was 34 percent. The resistance of 20 cm segments of tow at various parts along the length was measured, and the treatment was found to be fairly uniform. The best conductance obtained was 370 $ohm^{-1}cm^{-1}$, and the average, 170 $ohm^{-1}cm^{-1}$.

EXAMPLE V

Thermally stabilized acrylic fibrous material containing approximately 21 weight percent of associated copper sulfide was prepared under conditions similar to those described in Example IV and used for the preparation of composites based upon thermoplastic resins of polybutylene terephthalate. The fibers were sized with a conventional sizing material, chopped to ¼ inch lengths, and dried. The fibers were combined with dried polymer chip in portions of approximately 30 cc volume (amounting to about 40 g.) at levels of fiber content of 5, 10, 20 and 30 weight percent and compounded in a Brabender blender at 270° C. and 60 rpm. The periods of blending were 6–10 minutes for the compositions containing 10 and 20 percent fibers, and up to 20 minutes for the compositions containing 5 and 30 percent fibers. The resulting mixture was not redried prior to compaction, but this would be the preferred procedure.

Panels measuring 3'×3'×⅛' were compression molded from the mixtures by compaction at 4500 psi for 45 seconds after 4 minutes preheating to 260° C., followed by cold compaction at 20,000 psi. The panels weighed over 20 grams each, and had densities between 1.05 and 1.25 g/cc.

Volume resistivity of the molded composites was calculated from the resistance measured along the length of a 65×6 mm strip cut from the panels, using Electrodag paste contacts as in Example I. Although the fibers used in these composites were ten times more resistive than the best of the batch produced and the electrode contacts were not optimum, the lowest volume resistivity calculated was 40 ohm-cm at a 20 volume percent fiber loading level. Several improvements can be made in the conductive treatments of the fibers and in the compounding with polymer to lower the composite resistivity to the 1–10 ohm-cm region which is suitable for most EMI shielding. Even these composites with 10 and 20 weight percent fiber loading had electrical conductivity several orders of magnitude higher than those of polycarbonates filled with carbon or graphite fibers at equivalent loadings, illustrating the potentially high conductivities possible with polymer compositions containing the conductive fibers of the present invention.

Although the invention has been described with preferred embodiments, it is to be understood that variations and modifications may be employed without departing from the concept of the invention as defined in the following claims.

We claim:

1. A process for preparing an electrically conductive fibrous material from a thermally stabilized acrylic fibrous material comprising the steps of:

(a) contacting said thermally stabilized acrylic fibrous material with a source of cuprous ions to produce a cuprous ion-impregnated thermally stabilized acrylic fibrous material; and (b) contacting the resulting cuprous ion-impregnated thermally stabilized acrylic fibrous material with a sulfiding agent capable of sulfiding said cuprous ions to form electrically conductive covellite copper sulfide in association with said thermally stabilized acrylic fibrous material.

2. The process of claim 1, wherein the resulting thermally stabilized acrylic fibrous material with copper sulfide associated therewith is washed to remove residual reactants adhering thereto.

3. The process of claim 1, wherein said thermally stabilized acrylic fibrous material prior to step (a) is derived from an acrylonitrile homopolymer or an acrylonitrile copolymer containing at least about 85 mole percent acrylonitrile units and up to about 15 mole percent of one or more monovinyl units copolymerized therewith and which is non-burning when subjected to an ordinary match flame.

4. The process of claim 1, wherein said cuprous ion-impregnated thermally stabilized acrylic fibrous material is contacted with said sulfiding agent under conditions effective to form copper sulfide which is substantially entirely in the form of covellite copper sulfide.

5. The process of claim 1, wherein said cuprous ions of step (a) are present in an aqueous solution containing copper ions in a concentration of from approximately 0.25 to 10 percent by weight based upon the total weight of the solution.

6. The process of claim 1, wherein said source of cuprous ions of step (a) is generated in situ by reduction of cupric ions.

7. The process of claim 6, wherein said reduction of said cupric ions is performed in the presence of a reducing agent selected from the group consisting of hydroxylamine, hydroxylamine addition salts, sodium hypophosphite, sodium bisulfite, sodium dithionite, sodium formaldehyde sulfoxylate, zinc formaldehyde sulfoxylate, and mixtures thereof.

8. The process of claim 6, wherein said reduction of said cupric ions is performed in the presence of a hydroxylamine addition salt reducing agent selected from the group consisting of hydroxylamine sulfate, hydroxylamine hydrochloride, hydroxylamine nitrate, hydroxylamine acetate, hydroxylamine formate, hydroxylamine bromide, and mixtures thereof.

9. The process of claim 6, wherein said reduction of said cupric ions is performed in the presence of a reducing agent comprising copper metal in the form of powder, turnings, wire or other finely divided materials.

10. The process of claim 6, wherein said cupric ions are supplied in the form of a water-soluble cupric salt.

11. The process of claim 10, wherein said cupric salt is selected from the group consisting of cupric sulfate, cupric chloride, cupric nitrate, cupric acetate, cupric formate, cupric bromide, cupric perchlorate, complex salts of copper comprising cupric ions, and mixtures thereof.

12. The process of claim 6, wherein said cupric ions are supplied as cupric sulfate.

13. The process of claim 7, wherein said reducing agent is present in an aqueous solution in a concentration of from approximately 0.1 to 20 percent by weight based upon the total weight of the solution.

14. The process of claim 1, wherein said sulfiding agent of step (b) is selected from the group consisting of sodium thiosulfate, potassium thiosulfate, lithium thiosulfate, rubidium thiosulfate, cesium thiosulfate, sodium sulfide, sulfur dioxide, sodium hydrogen sulfite, sodium pyrosulfite, sulfurous acid, dithionous acid, sodium dithionite, thiourea dioxide, hydrogen sulfide, sodium formaldehyde sulfoxylate, and zinc formaldehyde sulfoxylate, and mixtures thereof.

15. The process of claim 14, wherein said sulfiding agent is present in an aqueous solution in a concentration of from approximately 0.1 to 30 percent by weight based upon the total weight of the solution.

16. The process of claim 7, wherein a combination reducing and sulfiding agent is used.

17. The process of claim 16, wherein said combination reducing and sulfiding agent is selected from the group consisting of sodium hydrogen sulfite, sodium dithionite, sodium formaldehyde sulfoxylate, zinc formaldehyde sulfoxylate, and mixtures thereof.

18. The process of claim 1, wherein prior to step (a), said thermally stabilized acrylic fibrous material is washed with a solvent to remove impurities associated therewith.

19. The process of claim 18, wherein said solvent is maintained at an elevated temperature in the range of from about 30° C. to the boiling point of said solvent.

20. The process of claim 18, wherein said solvent is selected from the group consisting of aliphatic alcohols having from 1 to about 3 carbon atoms, halocarbons having from 1 to about 3 carbon atoms, and halogenated hydrocarbons having from 1 to about 3 carbon atoms.

21. The process of claim 18, wherein said solvent is methanol and said washing is conducted under reflux conditions.

22. The process of claim 1, wherein steps (a) and (b) are conducted at an elevated temperature.

23. The process of claim 1, wherein said steps (a) and (b) are conducted while at temperatures within the range of approximately 80° to 150° C.

24. The process of claim 23, wherein said fibrous material is allowed to cool at least partially after step (a), and then is heated gradually to the treatment temperature for step (b).

25. The process of claim 1, wherein said thermally stabilized acrylic fibrous material contains between about 5 and about 60 percent by weight of said electrically conductive covellite copper sulfide at the conclusion of step (b), based upon the total weight of the product.

26. The process of claim 25, wherein said thermally stabilized acrylic fibrous material contains between about 35 and 60 percent by weight of said electrically conductive covellite copper sulfide at the conclusion of step (b), based upon the total weight of the product.

27. The process of claim 1, wherein said thermally stabilized acrylic fibrous material is present in a form selected from the group consisting of staple yarn, continuous filament yarn, multifilamentary tow, tape, strand, cable, fibrils, fibrids, papers, woven fabric, and nonwoven fabric.

28. A process for preparing an electrically conductive fibrous material from a thermally stabilized acrylic fibrous material comprising the steps of:

(a) cuprous ion-impregnating said thermally stabilized acrylic fibrous material with an aqueous solution to which was added a concentraton in the range of approximately 0.25 to 10 weight percent of copper ions, added as cupric sulfate, and between about 0.5 and 10 weight percent of an hydroxylamine reducing agent, while at a temperature of between about 80° and about 105° C. for between about 1 and about 2 hours;

(b) subjecting the resulting cuprous ion-impregnated fibrous material to a sulfiding treatment in a solution comprising a thiosulfate sulfiding agent in a concentration of approximately 5 to 15 percent by weight while at a temperature of between about 90° and about 105° C. for an additional period of time between about 1 and about 2 hours effective to produce an electrically conductive fibrous material having covellite copper sulfide in association therewith; and (c) washing the resulting thermally stabilized acrylic fibrous material to substantially remove residual reactants adhering to same.

29. The process of claim 28, wherein said thermally stabilized acrylic fibrous material prior to step (a) is derived from an acrylonitrile homopolymer or an acrylonitrile copolymer containing at least about 85 mole percent acrylonitrile units and up to about 15 mole percent of one or more monovinyl units copolymerized therewith and which is non-burning when subjected to an ordinary match flame.

30. The process of claim 28, wherein said copper sulfide resulting from step (b) is substantially entirely in the form of covellite copper sulfide.

31. An electrically conductive fibrous material comprising thermally stabilized acrylic fibrous material in association with approximately 5 to 60 percent by weight of covellite copper sulfide, based upon the total weight of the product.

32. The electrically conductive fibrous material of claim 31, wherein said covellite copper sulfide is primarily located on the surface of the fibrous material.

33. The electrically conductive fibrous material of claim 31, comprising from about 5 to about 15 weight percent of said covellite copper sulfide.

34. The electrically conductive fibrous material of claim 31, comprising from about 25 to about 35 weight percent of said covellite copper sulfide.

35. The electrically conductive fibrous material of claim 31, comprising from about 35 to about 60 weight percent of said covellite copper sulfide.

36. The electrically conductive fibrous material of claim 31, wherein said fibrous material exhibits an electrical conductivity in the direction of its length of between about 0.001 and about 1000 $ohm^{-1}cm^{-1}$ at 25° C.

37. The electrically conductive fibrous material of claim 35, wherein said fibrous material exhibits an electrical conductivity in the direction of its length of between about 500 and about 1000 $ohm^{-1}cm^{-1}$ at 25° C.

38. A process for preparing an electrically conductive composite article comprising the steps of:

(a) cuprous ion-impregnating a thermally stabilized acrylic fibrous material with a solution of a cupric salt and a reducing agent capable of reducing cupric ions to cuprous ions;

(b) subjecting the resulting cuprous ion-impregnated thermally stabilized fibrous material to a sulfiding treatment in a solution comprising a sulfiding agent capable of sulfiding said cuprous ions to covellite copper sulfide in association with said fibrous material to produce electrically conductive thermally stabilized acrylic fibrous material;

(c) washing the resulting electrically conductive thermally stabilized acrylic fibrous material to substantially remove residual reactants adhering to the same; and (d) surrounding said resulting electrically conductive fibrous material with a substantially continuous resinous matrix to produce a monolithic electrically conductive composite article.

39. The process of claim 38, wherein said thermally stabilized acrylic fibrous material prior to step (a) is derived from an acrylonitrile homopolymer or an acrylonitrile copolymer containing at least about 85 mole percent acrylonitrile units and up to about 15 mole percent of one or more monovinyl units copolymerized therewith and which is non-burning when subjected to an ordinary match flame.

40. The process of claim 38, wherein said copper sulfide resulting from step (b) is substantially entirely in the form of covellite copper sulfide.

41. The process of claim 38, wherein said reducing agent is selected from the group consisting of hydroxylamine, hydroxylamine addition salts, sodium hypophosphite, sodium bisulfite, sodium dithionite, sodium formaldehyde sulfoxylate, zinc formaldehyde sulfoxylate, and mixtures thereof.

42. The process of claim 38, wherein said cupric salt is cupric sulfate.

43. The process of claim 38, wherein said reducing agent of step (a) is present in an aqueous solution in a concentration of approximately 0.1 to 20 percent by weight.

44. The process of claim 38, wherein said cuprous ions of step (a) are present in an aqueous solution containing copper ions in a concentration of approximately 0.25 to 10 percent by weight.

45. The process of claim 38, wherein said steps (a) and (b) are conducted at temperatures within the range of approximately 80° to 105° C.

46. The process of claim 38, wherein said electrically conductive composite article comprises between about 0.5 and about 35 percent by volume of said electrically conductive thermally stabilized acrylic fibrous material.

47. The process of claim 38, wherein said electrically conductive composite article comprises between about 0.5 and about 2.5 percent by volume of said electrically conductive thermally stabilized acrylic fibrous material.

48. The process of claim 38, wherein said electrically conductive composite article comprises between about 1 and about 10 percent by volume of said electrically conductive thermally stabilized acrylic fibrous material.

49. The process of claim 38, wherein said electrically conductive composite article comprises between about 10 and about 30 percent by volume of said electrically conductive thermally stabilized acrylic fibrous material.

50. The process of claim 38, wherein said substantially continuous resinous matrix comprises at least one polymer selected from the group consisting of thermoplastic polymers, thermosetting polymers and natural rubbers.

51. The process of claim 50, wherein said thermoplastic polymer is selected from the group consisting of silicone polymers, polyurethanes, neoprenes, polyolefins, vinyl polymers, ABS copolymers, polyacrylics, polycarbonates, polyamides, polyesters, polyphenylene oxide, polyphenylene sulfide, polysulfones, polyether sulfones, polyetherimides, polyarylates, polyacetals, and mixtures thereof.

52. The process of claim 50, wherein said thermosetting polymer is selected from the group consisting of epoxy resins, silicone resins, polyester resins, melamine resins, phenolic resins, polyimide resins, and mixtures thereof.

53. The process of claim 38, wherein said polymeric matrix is cured by thermal, chemical or radiolytic curing means.

54. The process of claim 38, wherein said composite article is formed by molding a thermoplastic molding composition comprising said electrically conductive fibrous material.

* * * * *